US012618408B2

(12) United States Patent
Wang

(10) Patent No.: US 12,618,408 B2
(45) Date of Patent: May 5, 2026

(54) COMPRESSOR AND ADDITIONAL OIL INJECTION SYSTEM HAVING SAME

(71) Applicant: ATLAS COPCO (WUXI) COMPRESSOR CO., LTD., Jiangsu (CN)

(72) Inventor: Chunlin Wang, Jiangsu (CN)

(73) Assignee: ATLAS COPCO (WUXI) COMPRESSOR CO., LTD., Jiangsu (CN)

( * ) Notice: Subject to any disclaimer, the term of this patent is extended or adjusted under 35 U.S.C. 154(b) by 0 days.

(21) Appl. No.: 18/856,805

(22) PCT Filed: Apr. 7, 2023

(86) PCT No.: PCT/CN2023/086833

§ 371 (c)(1),
(2) Date: Oct. 14, 2024

(87) PCT Pub. No.: WO2023/197944

PCT Pub. Date: Oct. 19, 2023

(65) Prior Publication Data

US 2025/0283468 A1 Sep. 11, 2025

(30) Foreign Application Priority Data

Apr. 13, 2022 (CN) ..... 202210389614.8
Apr. 13, 2022 (CN) ..... 202220863513.5

(51) Int. Cl.
*F04C 29/02* (2006.01)
*F04C 18/16* (2006.01)

(52) U.S. Cl.
CPC ..... *F04C 29/028* (2013.01); *F04C 18/16* (2013.01); *F04C 2270/19* (2013.01)

(58) Field of Classification Search
CPC ..... F04C 29/028; F04C 29/02; F04C 29/12; F04C 29/0007; F04C 27/02; F04C 18/06; F04C 18/0215; F04C 2/16; F04C 2270/19
See application file for complete search history.

(56) References Cited

U.S. PATENT DOCUMENTS 4,452,575 A 6/1984 Schibbye et al.
5,653,585 A * 8/1997 Fresco ..... F25B 1/047 418/94

(Continued)

FOREIGN PATENT DOCUMENTS

CN 108019349 A 5/2018
CN 209510641 U 10/2019

(Continued)

OTHER PUBLICATIONS

ISA/CN, International Search Report for PCT/CN2023/086833, mailed Jul. 7, 2023, 3 pages.

*Primary Examiner* — Dapinder Singh
(74) *Attorney, Agent, or Firm* — Meunier Carlin & Curfman LLC

(57) ABSTRACT

A compressor and an additional oil injection system with the compressor are disclosed. The compressor (1) has a compression chamber (11) and an exhaust port (12), wherein, the compression chamber (11) is communicated with the exhaust port (12), the compression chamber (11) has an oil inlet of the compression chamber (18), and an oil injection port of exhaust port (13) is provided at the exhaust port (12).

14 Claims, 2 Drawing Sheets

(56) References Cited

U.S. PATENT DOCUMENTS

| | | | | |
|---|---|---|---|---|
| 7,647,790 | B2 * | 1/2010 | Ignatiev | F04C 29/0014 62/473 |
| 10,371,149 | B2 * | 8/2019 | Lodefier | F04C 18/16 |
| 11,118,585 | B2 * | 9/2021 | Crum | F04C 18/16 |
| 2012/0207634 | A1 * | 8/2012 | Heger | F04C 29/0014 418/206.8 |
| 2013/0058822 | A1 * | 3/2013 | Feller | F04C 29/028 418/84 |
| 2024/0287989 | A1 * | 8/2024 | Wang | F04C 23/001 |

FOREIGN PATENT DOCUMENTS

| | | | |
|---|---|---|---|
| CN | 211623712 | U | 10/2020 |
| CN | 113217390 | A | 8/2021 |
| CN | 113266572 | A | 8/2021 |
| CN | 217055588 | U | 7/2022 |
| GB | 1512507 | A | 6/1978 |
| JP | H01257789 | A | 10/1989 |
| JP | H116489 | A | 1/1999 |

* cited by examiner

COMPRESSOR AND ADDITIONAL OIL INJECTION SYSTEM HAVING SAME

CROSS REFERENCE TO RELATED APPLICATIONS

This application claims the priority of the patent application with the filing date of Apr. 13, 2022, application Ser. No. 202210389614.8, and the title of the patent application "compressor and additional oil injection system with the compressor", and the priority of the patent application with the filing date of Apr. 13, 2022, application Ser. No. 202220863513.5, and the title of the patent application "compressor and additional oil injection system with the compressor", the contents of which are incorporated herein by reference in their entirety.

TECHNICAL FIELD

The present application relates to the technical field of compressors, in particular to a compressor and an additional oil injection system with the compressor.

BACKGROUND

The oil injected screw compressors are widely used in textile, glass, cement, fermentation and other fields. The oil injected screw compressors in the market have high energy consumption and low compression efficiency.

The existing solutions improve the performance of the compressors by reducing the quantity of injected oil in the oil injected screw compressors, but they will bring some problems such as a high compressor outlet temperature, a sharply shortened life of lubricating oil and so on. The problems of high energy consumption and low compression efficiency will be caused if only the quantity of injected oil into the oil inlet of the compressor element is increased.

SUMMARY OF THE PRESENT INVENTION

The present application aims at solving at least one of the above-mentioned technical problems in the prior art to a certain extent. In view of this, the present application provides a compressor in which a part of oil can continue to provide cooling after the compression is completed.

The present application also provides an additional oil injection system with the above-mentioned compressor.

The compressor according to the embodiment of the present application has a compression chamber and an exhaust port, wherein, the compression chamber is communicated with the exhaust port, the compression chamber has an oil inlet of the compression chamber, and an oil injection port of the exhaust port is provided at the exhaust port.

According to the embodiment of the present application, a part of oil in the mentioned compressor can be injected to the compression chamber through the oil inlet of the compression chamber so as to seal, lubricate and cool the compression chamber; and the other part of oil can be injected to the exhaust port through the oil injection port of the exhaust port to cool the gas at the exhaust port.

According to some embodiments of the present application, the oil injection port of the exhaust port is configured as an oil injection nozzle, wherein, the oil injection nozzle is inserted into the exhaust port from one end of the compressor and the oil injection nozzle is provided with a plurality of oil injection holes.

According to some embodiments of the present application, the compressor includes a compressor element and an exhaust end face provided on the compressor element, wherein, the compression chamber is formed in the compressor element, while the exhaust port is opened on the exhaust end face, and the oil injection port of the exhaust port is configured as a plurality of oil injection holes formed on the exhaust end face.

According to some embodiments of the present application, the compressor is a single-stage oil injected screw compressor.

According to some embodiments of the present application, the compressor is a single-stage low-pressure oil injected screw compressor or a single-stage high-pressure oil injected screw compressor.

An additional oil injection system according to another embodiment of the present application comprises an oil reservoir, a main oil circuit, an oil pump and the above compressor. One end of the main oil circuit is communicated with the oil reservoir, while the other end of the main oil circuit is communicated with a first branched oil circuit and a second branched oil circuit. The first branched oil circuit is communicated with the oil inlet of the compression chamber, and the second branched oil circuit is communicated with the oil injection port of the exhaust port. The oil pump is at least used to provide the power for oil to flow from the oil reservoir to the second branched oil circuit.

According to some embodiments of the present application, the oil pump is provided on the second branched oil circuit to drive the oil in the second branched oil circuit to flow.

According to some embodiments of the present application, the oil pump is provided on the main oil circuit to drive the oil in the first branched oil circuit and the second branched oil circuit to flow.

According to some embodiments of the present application, the additional oil injection system further comprises an oil relief circuit, wherein, one end of the oil relief circuit is connected with the main oil circuit, the other end of the oil relief circuit is communicated with the oil reservoir, and the oil relief circuit is provided with an overflow valve, the overflow valve being configured as such that if the oil pressure of the oil relief circuit exceeds a preset pressure value, the overflow valve is opened, while if the oil pressure of the oil relief circuit does not exceed the preset pressure value, the overflow valve is closed.

Alternatively, the oil pump is provided on the main oil circuit, and the one end of the oil relief circuit is connected to an oil outlet of the oil pump.

According to some embodiments of the present application, the second branched oil circuit is provided with a flow volume regulating valve, and a valve opening degree of the flow volume regulating valve is adjustable.

Further, the additional oil injection system further comprises a temperature detection element and a controller, wherein, the temperature detection element is used to detect the temperature of gas discharged from the exhaust port, both the temperature detection element and the flow volume regulating valve are electrically connected with the controller, and the controller is suitable for adjusting the valve opening degree of the flow volume regulating valve according to the temperature detected by the temperature detection element.

According to some embodiments of the present application, the main oil circuit is further provided with an oil cooler.

According to some embodiments of the present application, the oil reservoir is an oil-gas separation vessel, and the exhaust port is also connected with the oil reservoir through an exhaust pipe.

According to some embodiments of the present application, the oil reservoir is an oil-gas separation vessel, and an oil separation element of the oil-gas separation vessel is also connected with the compression chamber through an oil recirculation circuit.

According to some embodiments of the present application, the main oil circuit is further provided with an oil filter.

Additional aspects and advantages of the present application will be set forth in part in the following description, and in part will be obvious from the following description, or may be learned by practice of the present application.

Figure 1:
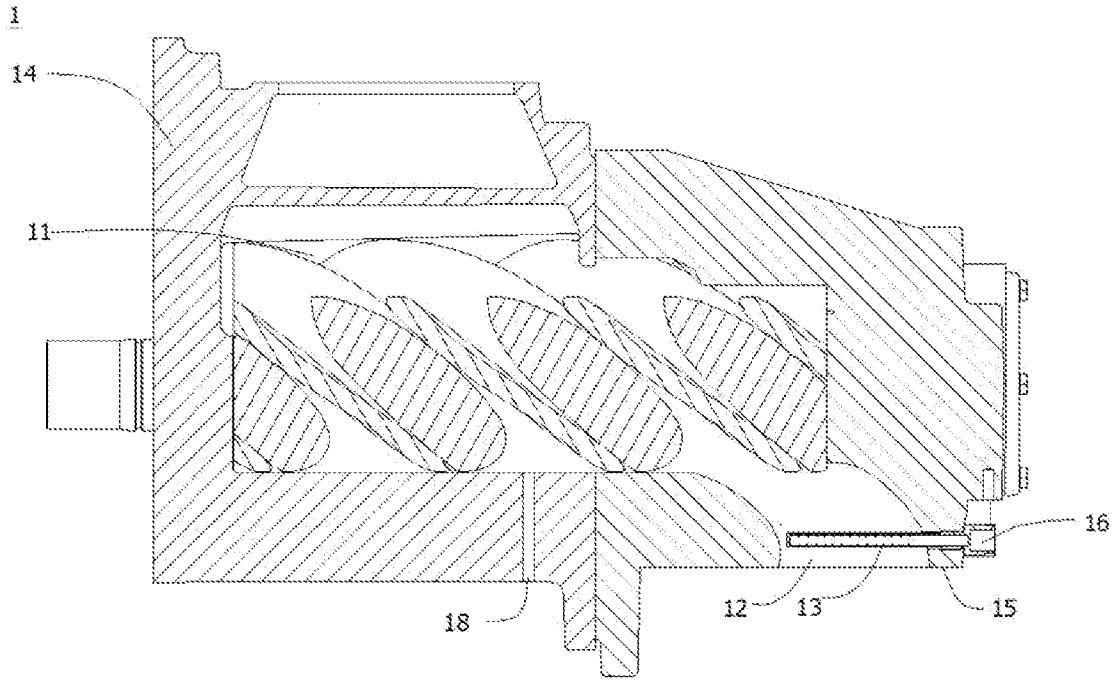
FIG. 1 shows schematically and in perspective a compressor according to one embodiment of the present application.

REFERENCE SIGNS compressor 1, compression chamber 11, exhaust port 12, oil injection port of the exhaust port 13, compressor element 14, exhaust end face 15, oil injection nozzle 16, oil inlet of the compression chamber 18, flow volume regulating valve 2, oil filter 3, overflow valve 4, oil pump 5, oil cooler 6, oil reservoir 7, oil separation element 8, main oil circuit 10, first branched oil circuit 20, second branched oil circuit 30, oil relief circuit 40, exhaust pipe 50, pipe 60, circuit 70.

DETAILED EMBODIMENTS

Hereinafter, embodiments of the present application will be described in detail, examples of which are shown in the accompanying drawings, in which the same or similar reference sign indicates the same or similar element or element having the same or similar functions throughout. The embodiments described below by referring to the drawings are exemplary and are intended to explain the present application, but not to be construed as limiting the present application.

In the description of the present application, it should be understood that the terms "longitudinal", "lateral", "length", "width", "thickness", "upper", "lower", "front", "rear", "left", "right", "vertical" and "horizontal", "top", "bottom", "inside", "outside" and the like indicate orientations or positional relationships based on the orientations or positional relationships shown in the accompanying drawings, and are only for the convenience of describing the present application and simplifying the description, rather than indicating or implying that the device or element referred to must have a specific orientation, be constructed and operate in a specific orientation, and therefore should not be understood as limiting the present application.

In the present application, unless otherwise specified and limited, the terms "installation", "connected", "connection" and "fixation" and the like should be broadly understood, for example, it can be fixed connection, detachable connection or integrated; it can be a mechanical connection, an electrical connection, or can be communicated with each other; it can be directly connected, or indirectly connected through an intermediate medium, it can be the internal connection of two elements or the interaction relationship between two elements. For those ordinary skilled in the art, the specific meanings of the above terms in the present application can be understood according to the specific circumstances.

A compressor 1 according to an embodiment of the present application will be described in detail combining to FIGS. 1 to 4.

Figure 2:
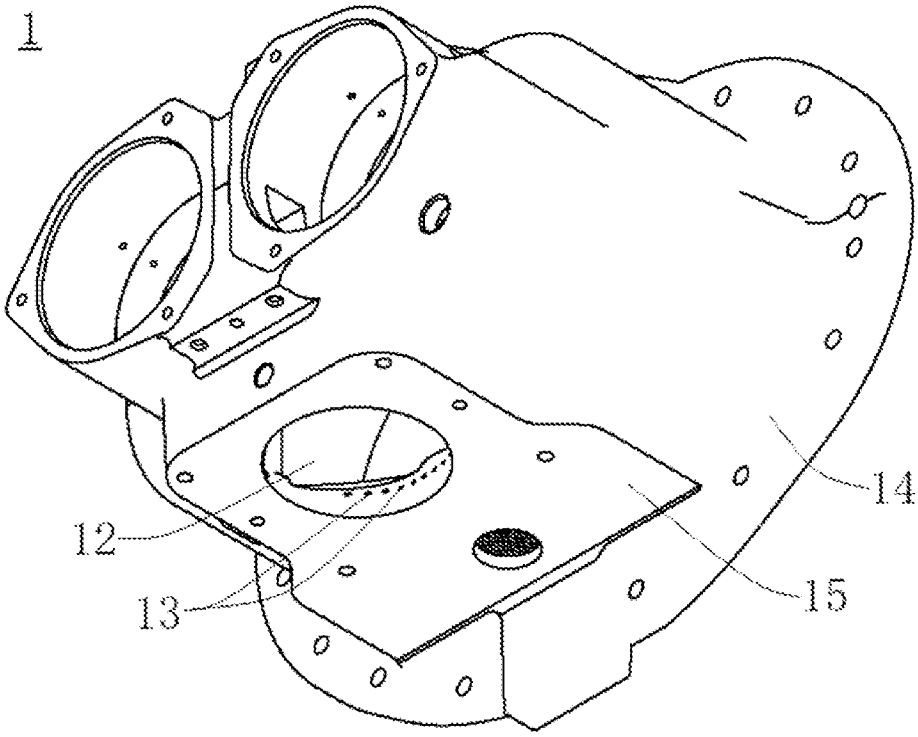
FIG. 2 shows schematically and in perspective a compressor according to another embodiment of the present application.

As shown in FIGS. 1-2, the compressor 1 according to the embodiment of the present application has a compression chamber 11 and an exhaust port 12, and compression parts for compressing gas are provided in the compression chamber 11. The compression chamber 11 has an oil inlet of the compression chamber 18, and when oil is injected into the compressor 1, a part of oil is injected into the compression chamber 11 through the oil inlet of the compression chamber 18 to lubricate and cool the compression part in the compression chamber 11, also cool the gas in the compression chamber 11, and seal some structures in the compression chamber 11.

The compression chamber 11 is communicated with the exhaust port 12, and an oil injection port of the exhaust port 13 is provided at the exhaust port 12. And another part of oil is injected to the exhaust port 12 through the oil injection port of the exhaust port 13 to cool the compressed gas at the exhaust port 12, in other words, these oil can continue to provide cooling for the compressed gas after the gas compression is completed.

According to the compressor 1 of the embodiment of the present application, by providing the oil inlet of the compression chamber 18, a part of oil can be injected to the compression chamber 11 through the oil inlet of the compression chamber 18 so as to seal, lubricate and cool the compression chamber 11; by providing the additional oil injection port of the exhaust port 13 at the exhaust port 12, a part of oil can be injected to the exhaust port 12 through the oil injection port of the exhaust port 13, so as to cool the compressed gas at the exhaust port 12, reduce the outlet temperature of the compressor 1, further reduce the oil temperature, make the oil work at the optimal temperature condition, and greatly prolong the working life of the oil. In addition, the separated oil injections in this way can make full use of the compression characteristic and cooling characteristic, maximize the cooling effect, reduce the mechanical loss, and improve the operating efficiency of the compressor 1.

In some embodiments of the present application, as shown in FIG. 1, the oil injection port of the exhaust port 13 is configured as an oil injection nozzle 16, which is inserted into the exhaust port 12 from one end of the compressor 1 near the exhaust port 12, and is provided with a plurality of oil injection holes. Oil can be injected to the exhaust port 12 through a plurality of oil injection holes to cool the compressed gas at the exhaust port 12. In addition, the structure of a plurality of oil injection holes is also beneficial to reduce the diameter of the oil injection holes, thereby increasing the force of oil injection, so as to form convection with the compressed gas at the exhaust port 12 and improve the cooling effect for the compressed gas.

Alternatively, the oil injection nozzle 16 can be configured as a rod structure or other shapes such as a bent structure, and a lengthwise direction of the oil injection nozzle 16 is suitable to be perpendicular to or at a certain angle with an air outlet direction of the exhaust port 12. When the compressed gas at the exhaust port 12 is discharged downwards, the oil injected from the oil injection holes on the oil injection nozzle 16 can be upward, thereby forming convection with the compressed gas to further improve the cooling effect for the compressed gas.

In some embodiments of the present application as shown in FIG. 2, the compressor 1 may comprise a compressor element 14 and an exhaust end face 15, and the compression chamber 11 is formed in the compressor element 14. For example, in some embodiments, the exhaust end face 15 and the compressor element 14 are configured in one casing; in some embodiments, the exhaust end face 15 and the compressor element 14 can be fixedly connected by screws, and are convenient to disassemble, so as to facilitate the repairs and the maintenances as well as other operations for the exhaust end face 15, the compressor element 14 and the compression parts in the compression chamber 11.

The exhaust port 12 is opened on the exhaust end face 15, and the oil injection port of the exhaust port 13 is configured as a plurality of oil injection holes formed on the exhaust end face 15. Similarly, oil can be injected to the exhaust port 12 through a plurality of oil injection holes to cool the compressed gas at the exhaust port 12. In addition, the structure of a plurality of oil injection holes is also beneficial to reduce the diameter of the oil injection holes, thereby increasing the oil injection force, so as to form convection with the compressed gas at the exhaust port 12 and improve the cooling effect for the compressed gas.

Alternatively, an axis of the plurality of oil injection holes may be perpendicular to an air outlet direction of the exhaust port 12. When the compressed gas at the exhaust port 12 is discharged downwards, the oil injected from the injection holes can be sprayed against the compressed gas from the side, forming convection with the compressed gas.

In some alternative embodiments of the present application, the compressor 1 is a single-stage oil injected screw compressor.

For example, in some alternative embodiments of the present application, the compressor 1 is a single-stage low-pressure oil injected screw compressor. Even if the compressor performance is improved by reducing the quantity of injected oil in the single-stage low-pressure oil injected screw compressor, since the oil injection port of the exhaust port 13 is provided at the exhaust port 12, a part of oil is injected to the exhaust port 12 through the oil injection port of the exhaust port 13 to cool the compressed gas at the exhaust port 12, so as to reduce the outlet temperature of the single-stage low-pressure oil injected screw compressor, further to reduce the oil temperature, to make the oil work at the optimal temperature condition, to greatly prolong the working life of oil, and to avoid the problems of high energy consumption and low compression efficiency caused by increasing the quantity of injected oil of the oil inlet of the compression chamber 18 of the compressor element independently.

For example, in other alternative embodiments of the present application, the compressor 1 is a single-stage high-pressure oil injected screw compressor. Even if the compressor performance is improved by reducing the quantity of injected oil in the single-stage high-pressure oil injected screw compressor, since the oil injection port of the exhaust port 13 is provided at the exhaust port 12, a part of oil is injected to the exhaust port 12 through the oil injection port of the exhaust port 13 to cool the compressed gas at the exhaust port 12, so as to reduce the outlet temperature of the single-stage high-pressure oil injected screw compressor, further to reduce the oil temperature, to make the oil work at the optimal temperature condition, to greatly prolong the working life of oil, and to avoid the problems of high energy consumption and low compression efficiency caused by increasing the quantity of injected oil of the oil inlet of the compression chamber 18 of the compressor element independently.

Figure 3:
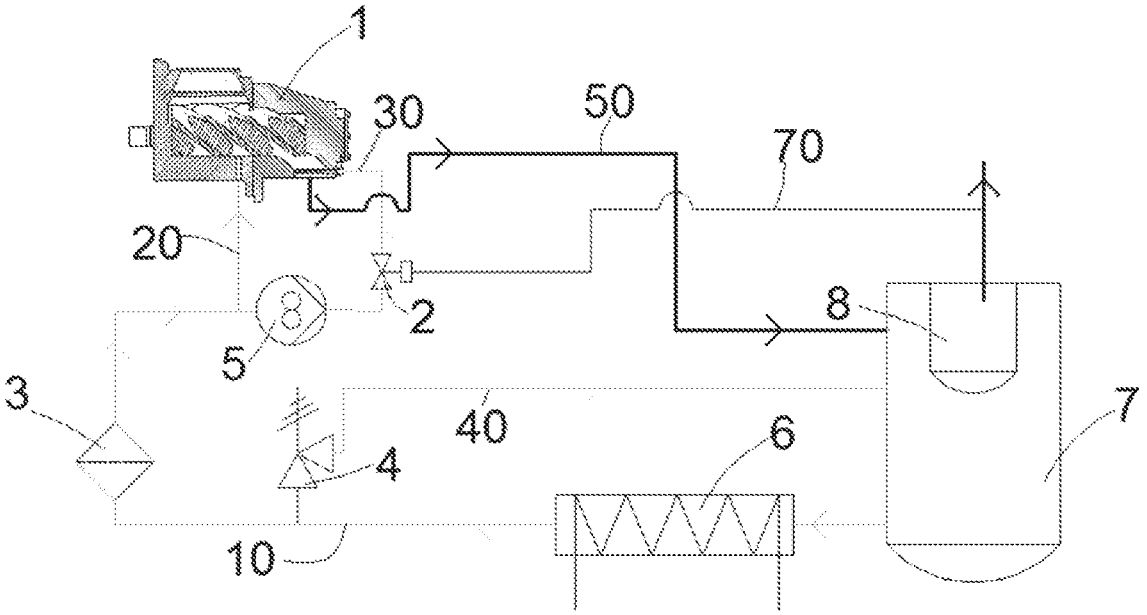
FIG. 3 shows schematically and in perspective an additional oil injection system according to one embodiment of the present application.
Figure 4:
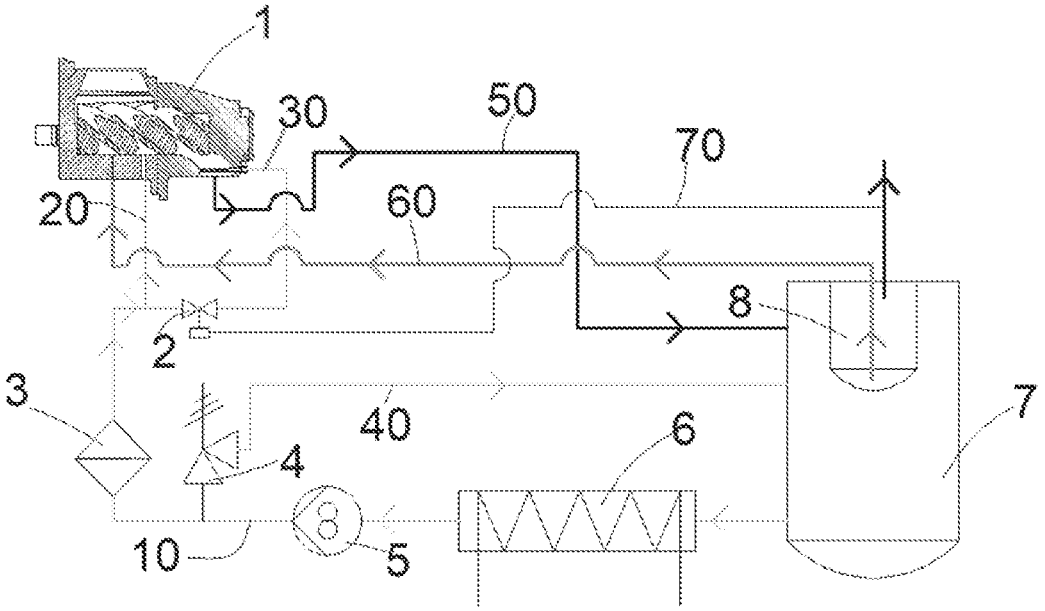
FIG. 4 shows schematically and in perspective an additional oil injection system according to another embodiment of the present application.

As shown in FIGS. 3-4, an additional oil injection system according to another embodiment of the present application may comprise an oil reservoir 7, a main oil circuit 10, an oil pump 5, and the compressor 1 of the above embodiment.

Among them, one end of the main oil circuit 10 is communicated with the oil reservoir 7, and the other end of the main oil circuit 10 is communicated with a first branched oil circuit 20 and a second branched oil circuit 30. The first branched oil circuit 20 is communicated with the oil inlet of the compression chamber 18, and the second branched oil circuit 30 is communicated with the oil injection port of the exhaust port 13. That is to say, the oil reservoir 7 can communicate with the main oil circuit 10, and a part of the oil in the main oil circuit 10 reaches the oil inlet of the compression chamber 18 through the first branched oil circuit 20, and then enters the compression chamber 11 so as to seal, lubricate and cool the compression chamber 11; while the other part of the oil reaches the oil injection port of the exhaust port 13 through the second branched oil circuit 30, and then is injected from the oil injection port of the exhaust port 13 to the exhaust port 12 to cool the compressed gas at the exhaust port 12.

The oil pump 5 is at least used to provide power for oil to flow from the oil reservoir 7 to the second branched oil circuit 30. In some alternative embodiments of the present application, the oil pump 5 may be an independent oil pump. In other alternative embodiments of the present application, the oil pump 5 may be an oil pump integrated with the compressor element.

In the description of the present application, it should be understood that the terms "first" and "second" are only used for descriptive purpose, and cannot be understood as indicating or implying relative importance or implicitly indicating the number of indicated technical features. Therefore, the features defined as "first" and "second" may comprise one or more of these features explicitly or implicitly. In the description of the present application, "plurality" means at least two, such as two, three and so on, unless otherwise specifically defined.

In some embodiments of the present application, as shown in FIG. 3, the oil pump 5 is provided on the second branched oil circuit 30, and under the circumstance, when the oil pump 5 works, it can drive the oil in the second branched oil circuit 30 to flow. That is to say, the oil pump 5 can provide power to drive the oil to flow from the oil reservoir 7 to the second branched oil circuit 30. The function of the oil pump 5 provided on the second branched oil circuit 30 is only to provide sufficient pressure difference for oil injection at the exhaust port 12.

Compared with providing the oil pump 5 on the main oil circuit 10, providing the oil pump 5 on the second branched oil circuit 30 facilitates reducing the power consumption of the oil pump 5.

In some embodiments of the present application, as shown in FIG. 4, the oil pump 5 is provided on the main oil circuit 10, and under the circumstance, when the oil pump 5 works, it can drive the oil in the first branched oil circuit 20 and the second branched oil circuit 30 to flow. That is to say, the oil pump 5 can provide power to drive the oil to flow from the oil reservoir 7 to the first branched oil circuit 20 and the second branched oil circuit 30.

In some embodiments of the present application, as shown in FIGS. 3-4, the additional oil injection system may further comprise an oil relief circuit 40. One end of the oil relief circuit 40 is connected with the main oil circuit 10, and the other end of the oil relief circuit 40 is connected with the oil reservoir 7, so as to recover the excess oil in the main oil circuit 10, that is to say, the excess oil in the main oil circuit 10 can flow back to the oil reservoir 7 through the oil relief circuit 40.

Further, the oil relief circuit 40 is provided with an overflow valve 4. The overflow valve 4 is configured as such that if the oil pressure in the oil relief circuit 40 exceeds a preset pressure value, the overflow valve 4 is opened, and under the circumstance, the main oil circuit 10 can communicate with the oil reservoir 7 through the oil relief circuit 40, and the excess oil in the main oil circuit 10 can flow back to the oil reservoir 7 through the oil relief circuit 40; when the oil pressure in the oil relief circuit 40 does not exceed the preset pressure value, the overflow valve 4 is closed, and under the circumstance, the excess oil in the main oil circuit 10 cannot flow back to the oil reservoir 7 through the oil relief circuit 40. The preset pressure value can be set according to the actual need of a user.

Alternatively, the oil pump 5 is provided on the main oil circuit 10, and one end of the oil relief circuit 40 is connected to the oil outlet of the oil pump 5. The oil pressure at the oil outlet of the oil pump 5 is relatively high. When the oil pressure at the oil outlet of the oil pump 5 exceeds the preset pressure value, the overflow valve 4 is opened; when the oil pressure at the oil outlet of the oil pump 5 does not exceed the preset pressure value, the overflow valve 4 is closed. Since the outlet pressure of compressor 1 changes under various working conditions, in order to ensure the constant pressure and safety of the additional oil injection system, it is necessary to add the overflow valve 4 at the oil outlet of the oil pump 5.

In some embodiments of the present application, the second branched oil circuit 30 is provided with a flow volume regulating valve 2, and the valve opening degree of the flow volume regulating valve 2 can be adjusted. That is to say, by adjusting the valve opening degree of the flow volume regulating valve 2, the quantity of oil reaching the oil injection port of the exhaust port 13 can be adjusted, thereby adjusting the quantity of oil injected from the oil injection port of the exhaust port 13 to the exhaust port 12.

Further, the additional oil injection system may further comprise a temperature detection element and a controller, the temperature detection element is used to detect the temperature of gas discharged from the exhaust port 12, and both the temperature detection element and the flow volume regulating valve 2 are electrically connected with the controller, for example, through a circuit 70. The controller is suitable for adjusting the valve opening degree of the flow volume regulating valve 2 according to the temperature detected by the temperature detecting element, so as to realize the intelligent control of the additional oil injection system. For example, when the temperature detected by the temperature detecting element exceeds a preset temperature value, the valve opening degree of the flow volume regulating valve 2 is increased to increase the quantity of oil reaching the oil injection port of the exhaust port 13, thereby increasing the quantity of oil injected from the oil injection port of the exhaust port 13 to the exhaust port 12. The preset temperature value can be set according to the actual need of the user, such as 30° C., 45° C. and so on.

Alternatively, the temperature detecting element may be a temperature sensor.

In some embodiments of the present application, the main oil circuit 10 is further provided with an oil cooler 6 for cooling oil in the main oil circuit 10.

In some embodiments of the present application, the oil reservoir 7 is an oil-gas separation vessel, and the exhaust port 12 is also connected with the oil reservoir 7 through an exhaust pipe 50.

In some embodiments of the present application, the oil reservoir 7 is an oil-gas separation vessel, and an oil separation element 8 of the oil-gas separation vessel is also connected with the compression chamber 11 through an oil recirculation circuit 60. The excess oil in the oil-gas separation vessel can enter the compression chamber 11 through the oil recirculation circuit 60.

In some embodiments of the present application, the main oil circuit 10 is further provided with an oil filter 3. In the embodiment shown in FIG. 4, the oil pump 5 is provided on the second branched oil circuit 30, and the oil filter 3 is located on the upstream side of the oil pump 5. In the embodiment shown in FIG. 4, the oil pump 5 is provided on the main oil circuit 10, and the oil filter 3 is provided at the oil outlet of the oil pump 5, that is, the oil filter 3 is located at the downstream side of the oil pump 5, so that impurities of the oil pump 5 will not be brought to the compression chamber 11 to damage the engaged rotors, nor will be brought to the oil injection port of the exhaust port 13 to block the oil injection port of the exhaust port 13.

The additional oil injection system shown in FIG. 4 comprises an oil reservoir 7, a main oil circuit 10, an oil pump 5 and a compressor 1. One end of the main oil circuit 10 is communicated with the oil reservoir 7, and the other end of the main oil circuit 10 is communicated with a first branched oil circuit 20 and a second branched oil circuit 30. An oil cooler 6, an oil pump 5 and an oil filter 3 are provided at the main oil circuit 10 in sequence.

The working process of the additional oil injection system can be descripted as follows: the oil from the oil-gas separation vessel 7 enters the main oil circuit 10, is firstly cooled by the oil cooler 6, then is pressurized by the oil pump 5, and then passes through the oil filter 3, and finally is injected into the compressor 1 in two separate circuits, wherein, a minor part of the oil passes through the first branched oil circuit 20 to reach the oil inlet of the compression chamber 18, and then enters the compression chamber 11, in order to lubricate, seal and partially cool the compression chamber 11, and the remaining major part of oil passes through the second branched oil circuit 30 to reach the oil injection port of the exhaust port 13, and is injected from the oil injection port of the exhaust port 13 to the exhaust port 12, mainly to cool the compressed air, and also to have the function of sealing the head clearance of compressor element.

The quantity of oil injected from the oil injection port of the exhaust port 13 to the exhaust port 12 depends on the operating conditions of the compressor 1, mainly on the rotational speed, compression ratio, gas inlet temperature and oil injection temperature of the compressor 1. The control method is to directly detect the temperature of the gas discharged from the exhaust port 12, or to detect the exhaust temperature of the oil reservoir 7, and the additional oil injection can be designed according to the optimal exhaust temperature range controlled by the oil injection volume (the specific range is determined by the working condition of the compressor 1 and the user's demand), or the maximum required quantity of injected oil.

In the description of this specification, descriptions referring to the terms "one embodiment", "some embodiments", "examples", "specific examples" or "some examples" mean that specific features, structures, materials or characteristics described in connection with this embodiment or example are comprised in at least one embodiment or example of the present application. In this specification, the schematic expressions of the above terms are not necessarily aimed at the same embodiment or example. Moreover, the specific features, structures, materials or characteristics described may be combined in any one or more embodiments or examples in a suitable manner. In addition, those skilled in the art can engage and combine different embodiments or examples described in this specification.

Although the embodiments of the present application have been shown and described as above, it can be understood that the above embodiments are exemplary and cannot be understood as limitations of the present application, and those ordinary skilled in the art can make changes, modifications, substitutions and variations to the above embodiments within the scope of the present application.

The invention claimed is:

1. An additional oil injection system, wherein the additional oil injection system comprises:

a compressor, wherein the compressor is a single-stage oil injected screw compressor, wherein the compressor has a compression chamber and an exhaust port, wherein the compressor comprises a compressor element and an exhaust end face provided on the compressor element, wherein, the compression chamber is formed in the compressor element, while the exhaust port is opened on the exhaust end face, the compression chamber is communicated with the exhaust port, the compression chamber has an oil inlet of the compression chamber, and an oil injection port of the exhaust port is provided at the exhaust port, an oil reservoir;

a main oil circuit, wherein, one end of the main oil circuit is communicated with the oil reservoir, the other end of the main oil circuit is communicated with a first branched oil circuit and a second branched oil circuit, the first branched oil circuit is communicated with the oil inlet of the compression chamber, and the second branched oil circuit is communicated with the oil injection port of the exhaust port; and an oil pump at least used to provide the power for oil to flow from the oil reservoir to the second branched oil circuit, wherein the oil pump is provided on the second branched oil circuit to drive the oil in the second branched oil circuit to flow;

wherein the additional oil injection system further comprises an oil relief circuit, wherein, one end of the oil relief circuit is directly connected with the main oil circuit, the other end of the oil relief circuit is directly connected with the oil reservoir, and the oil relief circuit is provided with an overflow valve, the overflow valve being configured as such that if the oil pressure of the oil relief circuit exceeds a preset pressure value, the overflow valve is opened, while when the oil pressure of the oil relief circuit does not exceed the preset pressure value, the overflow valve is closed.

2. The additional oil injection system according to claim 1, wherein the second branched oil circuit is provided with a flow volume regulating valve, and a valve opening degree of the flow volume regulating valve is adjustable.

3. The additional oil injection system according to claim 2, wherein further comprising a temperature detection element and a controller, wherein, the temperature detection element is used to detect the temperature of gas discharged from the exhaust port, both the temperature detection element and the flow volume regulating valve are electrically connected with the controller, and the controller is suitable for adjusting the valve opening degree of the flow volume regulating valve according to the temperature detected by the temperature detection element.

4. The additional oil injection system according to claim 1, wherein the main oil circuit is further provided with an oil cooler.

5. The additional oil injection system according to claim 1, wherein the oil reservoir is an oil-gas separation vessel, and the exhaust port is also connected with the oil reservoir through an exhaust pipe.

6. The additional oil injection system according to claim 1, wherein the oil reservoir is an oil-gas separation vessel, and an oil separation element of the oil-gas separation vessel is also connected with the compression chamber through an oil recirculation circuit.

7. The additional oil injection system according to claim 1, wherein the main oil circuit is further provided with an oil filter.

8. The additional oil injection system according to claim 1, wherein the oil inlet of the compression chamber is provided, a part of oil is injected to the compression chamber through the oil inlet of the compression chamber, and a part of oil is injected to the exhaust port through the oil injection port of the exhaust port.

9. The additional oil injection system according to claim 1, wherein the oil injection port of the exhaust port is configured as an oil injection nozzle, wherein, the oil injection nozzle is inserted into the exhaust port from one end of the compressor near the exhaust port and is provided with a plurality of oil injection holes.

10. The additional oil injection system according to claim 9, wherein a lengthwise direction of the oil injection nozzle is suitable to be perpendicular to or at a certain angle with an air outlet direction of the exhaust port.

11. The additional oil injection system according to claim 10, wherein the oil injection nozzle is configured as a rod structure.

12. The additional oil injection system according to claim 1, wherein the oil injection port of the exhaust port is configured as a plurality of oil injection holes formed on the exhaust end face.

13. The additional oil injection system according to claim 12, wherein an axis of the plurality of oil injection holes is perpendicular to an air outlet direction of the exhaust port.

14. The additional oil injection system according to claim 1, wherein the compressor is a single-stage low-pressure oil injected screw compressor or a single-stage high-pressure oil injected screw compressor.

* * * * *